US009470476B1

(12) United States Patent
Gordon et al.

(10) Patent No.: US 9,470,476 B1
(45) Date of Patent: Oct. 18, 2016

(54) MORTAR RETENTION SYSTEM FOR AUTOMATED WEAPONS

(71) Applicants: Noah Gordon, Metuchen, NJ (US); Thomas Tighe, Morris Township, NJ (US); William Bartell, Hackettstown, NJ (US); Matthew Tomik, Easton, PA (US)

(72) Inventors: Noah Gordon, Metuchen, NJ (US); Thomas Tighe, Morris Township, NJ (US); William Bartell, Hackettstown, NJ (US); Matthew Tomik, Easton, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/596,422

(22) Filed: Jan. 14, 2015

(51) Int. Cl.

| | |
|---|---|
| ***F41F 1/06*** | (2006.01) |
| ***F41A 9/53*** | (2006.01) |
| *F41A 7/06* | (2006.01) |
| *F41A 17/18* | (2006.01) |

(52) U.S. Cl.
CPC . *F41F 1/06* (2013.01); *F41A 9/53* (2013.01); *F41A 7/06* (2013.01); *F41A 17/18* (2013.01)

(58) Field of Classification Search
CPC ..... F41A 9/53; F41A 17/06; F41A 17/18; F41F 1/06
USPC ..... 42/1.05; 89/45, 1.35, 37.05, 40.02
See application file for complete search history.

(56) References Cited

U.S. PATENT DOCUMENTS

| | | | | |
|---|---|---|---|---|
| 4,860,633 | A * | 8/1989 | Wiethoff | F41A 9/16 89/33.02 |
| 2004/0107620 | A1* | 6/2004 | Haefeli | F41A 19/01 42/1.05 |
| 2006/0011188 | A1* | 1/2006 | Jones | F41B 11/73 124/77 |
| 2013/0039655 | A1* | 2/2013 | Monks | F41B 11/57 398/43 |
| 2013/0180147 | A1* | 7/2013 | Lupher | F41A 19/58 42/69.01 |
| 2015/0000169 | A1* | 1/2015 | Righi | F41A 17/00 42/1.01 |

* cited by examiner

*Primary Examiner* — Bret Hayes
(74) *Attorney, Agent, or Firm* — Michael C. Sachs

(57) ABSTRACT

A retention system protects the round stored inside a rotating continuous belt-type magazine, and holds the round securely while allowing it to be readily and easily released prior to firing. The retention system permits all the retaining devices to be easily retracted so that a ramming mechanism of the weapon can push the round into the chamber without interference. The gun tube of the automated weapon houses the round and provides interfaces for all other components to attach. The tube length minimizes the axial movement of the round. The round is held within the tube by a front door assembly and a rear door assembly. The door assembly is made of a crescent-shaped door attached to a pivot shaft, in order to minimize the amount of rotational travel required to open the door for loading or firing the round.

8 Claims, 20 Drawing Sheets

25
20
105
106
A
B
10
5
30
11
12
13
14
15

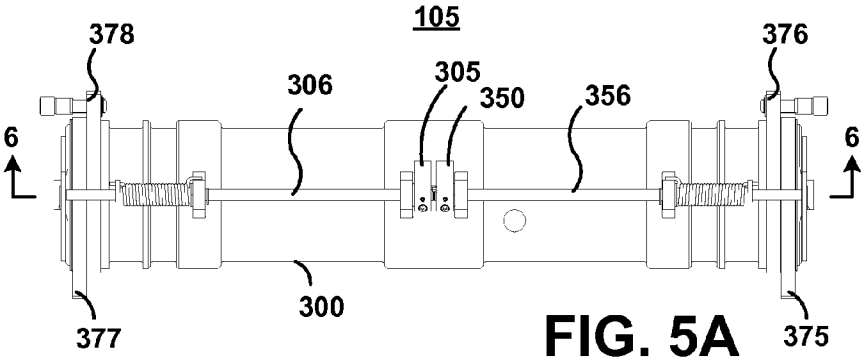
FIG. 5A
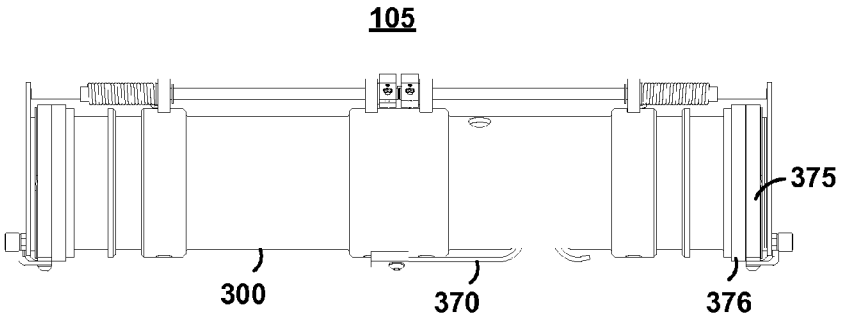
FIG. 5B
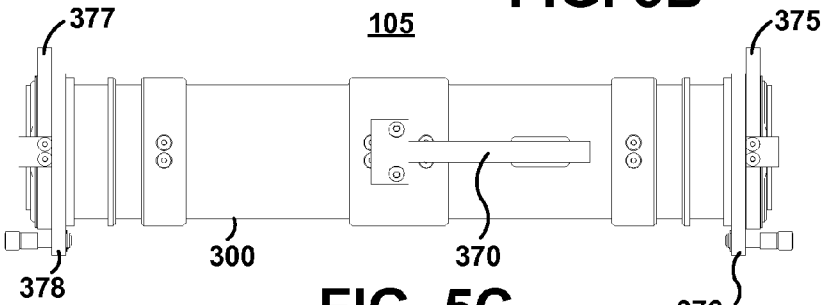
FIG. 5C
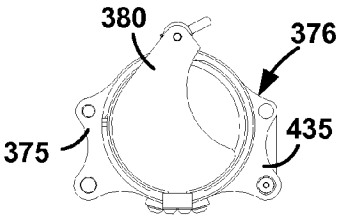
FIG. 5D
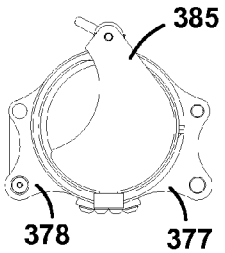
FIG. 5E
FIG. 5

MORTAR RETENTION SYSTEM FOR AUTOMATED WEAPONS

GOVERNMENTAL INTEREST

The invention described herein may be manufactured and used by, or for the Government of the United States for governmental purposes without the payment of any royalties thereon.

FIELD OF THE INVENTION

The present invention relates in general to the field of munitions. More specifically, this invention relates to a system and associated method for retaining, securing, and protecting the ammunition within a magazine or within an ammunition feeding mechanism of an automated weapon.

BACKGROUND OF THE INVENTION

One of the challenges of automating mortar weapons is the design of a system that handles and protects the ammunition. The standard mortar round is typically difficult to restrain securely within a magazine or ammunition feeding mechanism of an automated weapon. The round must be protected from gunfire shock, adverse weather conditions and transportation loads, while remaining ready to be fired without any user handling or intervention.

In addition, the mortar round includes delicate features, such as the aluminum fins and propellant charge increments, which must be protected from damage resulting from handling and transportation. To further exacerbate the concerns associated with traditional automated weapons, the ogive geometric shape and design of the mortar round does not provide a useful feature for securing the mortar within the ammunition feeding mechanism.

Previous methods of mortar round retention for automatic or semi-automatic weapons included storing the ammunition in a sealed container, clamping the round tightly with a friction hold or by interfacing with the tapered section of the mortar body. Storing the ammunition in a sealed container requires user handling before firing. The use of a retention device against the tapered section of the mortar body is prone to wedging and jamming. Maintaining sufficient friction to retain the round when subjected to transportation and firing loads has proven to be relatively difficult. Furthermore, the force applied to the round decreases over time and with repeated firing loads, with the springs taking a permanent set.

While these conventional methods provided a certain level of protection to the ammunition, there still remains a need for a more efficient retention system that secures and protects the ammunition within the feeding mechanism of an automated weapon.

SUMMARY OF THE INVENTION

The present invention addresses the foregoing concerns and presents a new retention system that protects the round stored inside a rotating continuous belt-type magazine, and that holds the round securely while allowing it to be readily and easily released prior to firing. The retention system permits all the retaining devices to be easily retracted so that a ramming mechanism of the weapon can push the round into the chamber without interference.

An ammunition magazine tube of the automated weapon houses the round and provides interfaces for all other components to attach. The tube length restricts the axial movement of the round.

The ammunition is held within the tube by a front door assembly and a rear door assembly. Each of these two door assemblies is made of a crescent-shaped door attached to a pivot shaft. The crescent shape permits the door to retain the ammunition during transportation, while minimizing the amount of rotational travel required to open the door for loading or firing the round.

The door assembly rotation is guided by two shaft supports for each of the two door assemblies. To open the doors, each door assembly is fitted with a release lever. A front release lever is actuated by the plunger of a firing solenoid and will open both the front and rear doors for firing. A rear release lever is actuated by a loading solenoid, but only opens the rear door, as required, for loading or resupplying ammunition into the magazine.

The doors are held in the closed position by torsion springs. The lower door supports provide additional support for the door when they are in the closed position, prevent cantilever type loading on the door shaft, and provide a positive rotational stop for each door.

The ammunition is also clamped in place by a formed clamping spring to prevent vibration during transportation. This clamping spring also provides a method of inventory control. When the head of the spring is forced downward by the round, it will fall into the range of a proximity sensor to indicate the presence of ammunition in the cell. The head also interfaces with a cam when the cell is driven to the firing position to further depress the spring, in order to completely release the ammunition prior to firing.

A linking collar assembly allows additional cells to be linked together to form a continuous chain. Each cell has four linking collars, two in the front and two in the rear.

The present retention system provides positive round retention while remaining readily releasable and protecting the critical areas of the round. The combination of the doors and clamp spring prevents axial movement and vibration of the mortar during transportation and firing loads seen by the system. The present design is not susceptible to jamming from a wedging action because there is no interface with the tapered section of the round. The doors are held closed by the torsion spring and are easily opened by means of solenoids.

BRIEF DESCRIPTION OF THE DRAWINGS

The accompanying drawings, which are incorporated in, and constitute part of this specification, illustrate embodiments of the invention and together with the description, serve to explain the principles of the invention. The embodiments illustrated herein are presently preferred, it being understood, however, that the present invention is not limited to the precise arrangements and instrumentalities shown, wherein:

FIG. 5 includes FIGS. 5A, 5B, 5C, 5D, and 5E, and represents various views of the storage cell of FIG. 4;

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figures 1A, 1B, 1C, 1D:
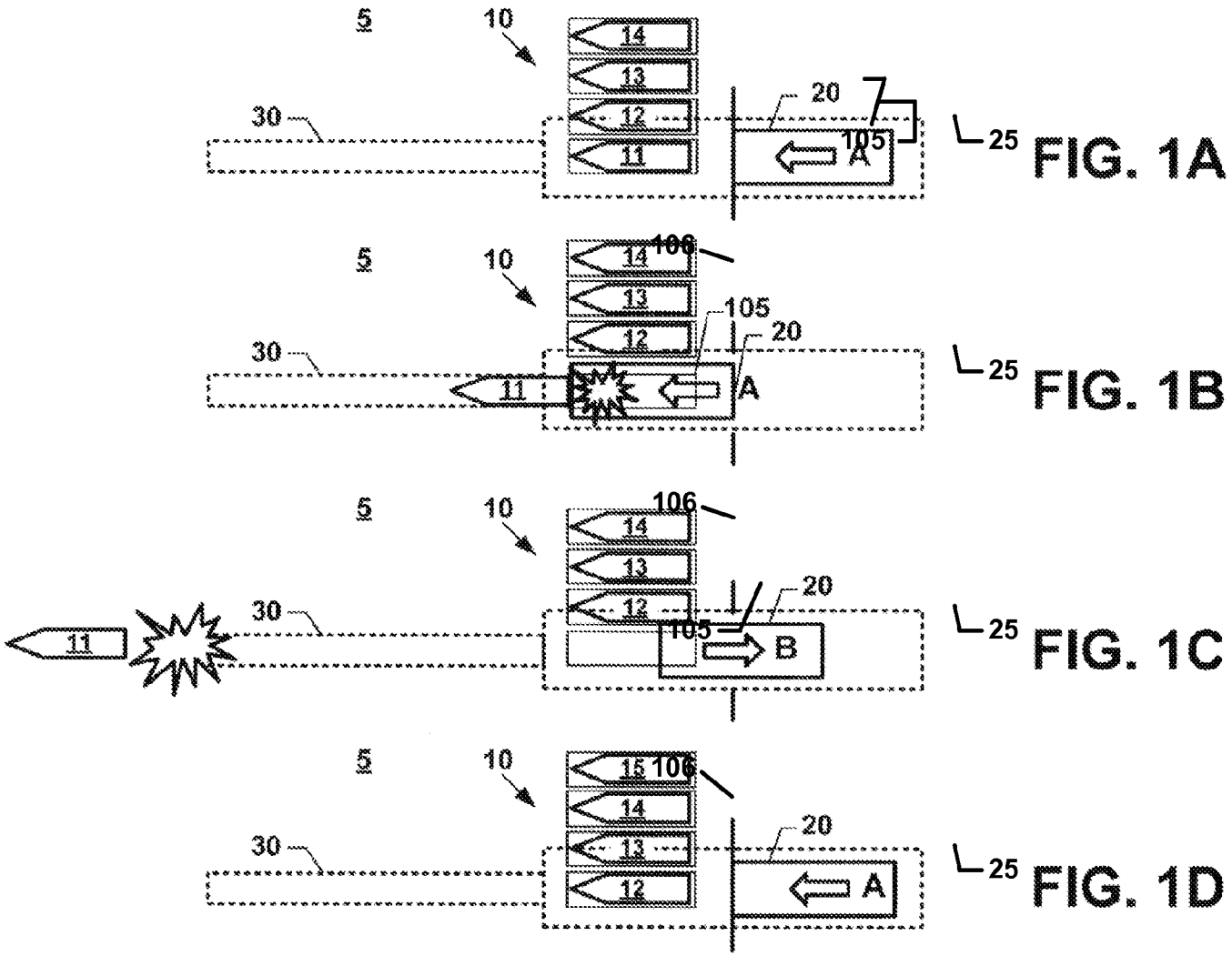
FIG. 1 includes FIGS. 1A, 1B, 1C, and 1D, and represents a schematic view of the operation of an automated weapon that is provided with an ammunition feeding mechanism, according to a preferred embodiment of the present invention.

With reference to FIG. 1, it illustrates an exemplary operation of an automated weapon 5 that is provided with an ammunition feeding mechanism 10, according to a preferred embodiment of the present invention. In this example, the automated weapon 5 includes a gun tube 30, and a recoiling mass 20 that translates back and forth within a firing chamber 25. As used herein, the term "recoiling mass" generally refers to the components of the automated weapon 5 that move in response to the energy of expending an round by the automated weapon 5. This term may encompass, for example, a breech or a ramming mechanism, recoil cylinders, recoil springs or firing mechanism.

Figure 2:
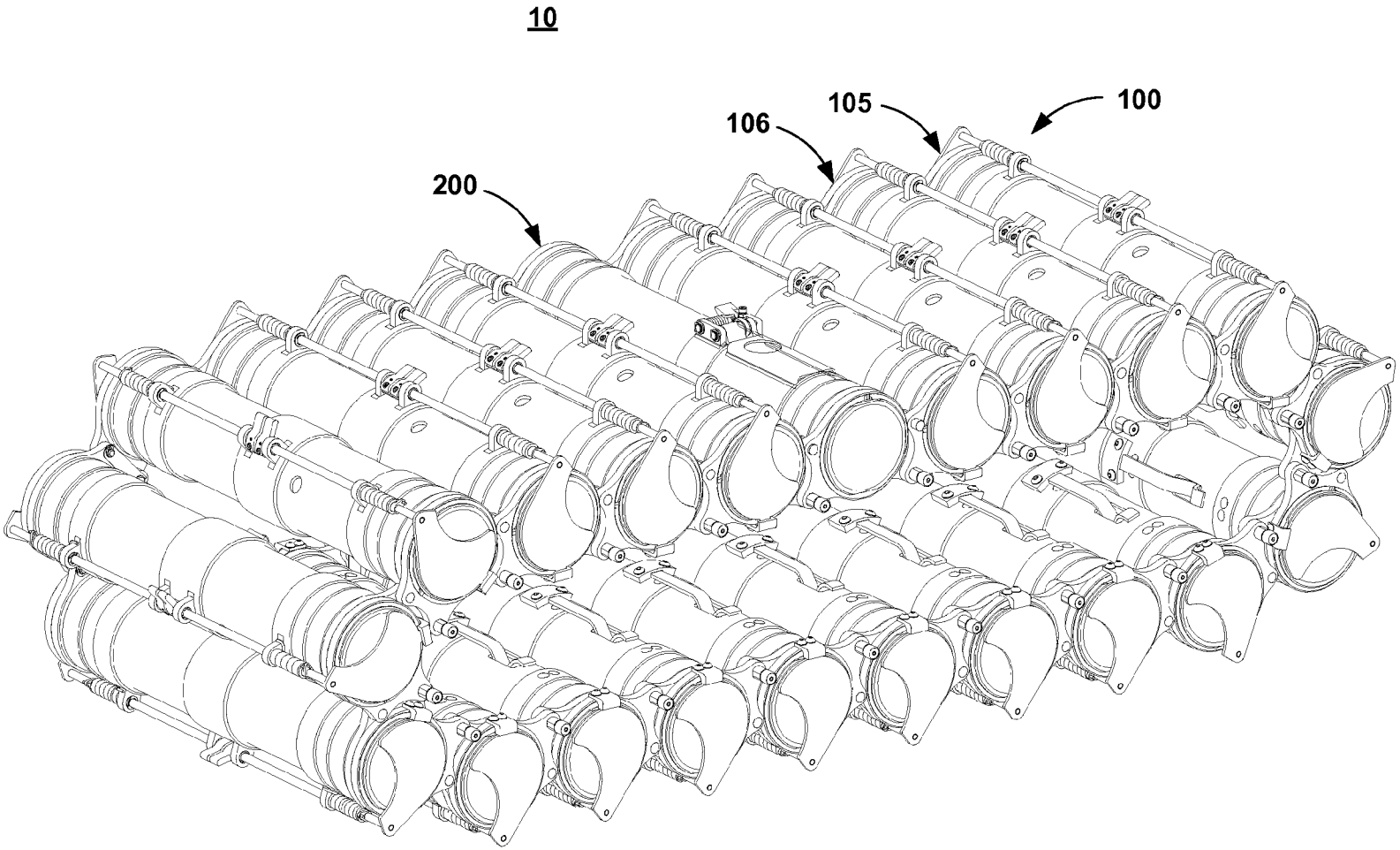
FIG. 2 is an isometric perspective view of the ammunition feeding mechanism shown in FIG. 1, such as a rotating, continuous belt-type magazine of the automated weapon, wherein the ammunition feeding mechanism is formed of a plurality of interconnected storage cells, each of which embodies a retention system according to an embodiment of the present invention, and one gun tube clearance cell which ensures that that the gun tube of the automated weapon is clear and unobstructed.

While the ammunition feeding mechanism 10 is shown as including four rounds 11, 12, 13, and 14, it should be clear that the ammunition feeding mechanism 10 can be provided with a different number of rounds, wherein each round, i.e., 11, 12, is respectively stored in a storage cell, i.e., 105, 106 (FIG. 2).

As further illustrated in FIG. 2, the ammunition feeding mechanism 10, can be, for example, a rotating, continuous belt-type magazine of the automated weapon 5. The ammunition feeding mechanism (or magazine) 10 of this particular example, is formed of a plurality of generally similar interconnected storage cells (i.e., 105, 106) each of which embodies a retention system 100 according to a preferred embodiment of the present invention. The ammunition feeding mechanism 10 is also comprised of one (or more) gun tube clearance cell 200, which ensures that the gun tube 30 of the automated weapon 5 is clear and unobstructed.

The general operation of the automated weapon 5 will now be described in connection with FIGS. 1A through 1D. FIG. 1A shows the first round 11 being chambered, and the recoiling mass 20 being cocked and latched. FIG. 1B shows the recoiling mass 20 unlatched and ramming the first round 11 forward, along the arrow A, causing the first round 11 to be fired through the gun tube 30.

FIG. 1C shows the first round 11 exiting the gun tube 30, resulting in a soft recoil effect, wherein the reaction forces ensuing from the firing of the first round 11 cause the recoiling mass 20 to move back, along the arrow B, and to latch. FIG. 1D illustrates the recoiling mass 20 latched, with the ammunition feeding mechanism 10 indexed to the next round 12. While the preferred embodiment is described in terms of a soft recoil effect, it should be amply clear that the present invention is not limited to soft recoil mechanisms, and that an exemplary soft recoil mechanism is presented herein for illustration purpose and does not purport to be the exclusive embodiment covered by the present invention.

Figure 3:
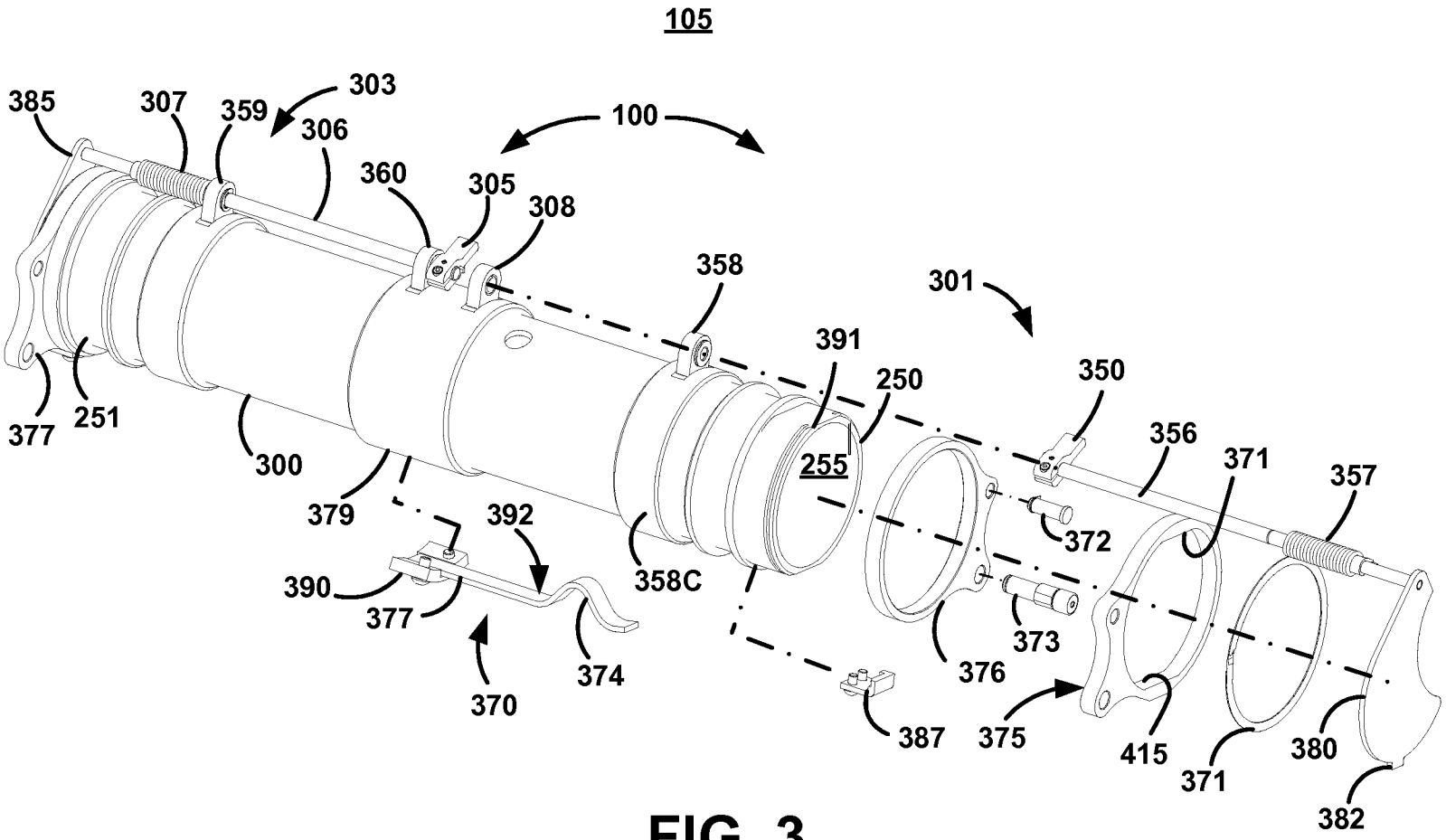
FIG. 3 is a partly exploded view of a storage cell that forms part of the ammunition feeding mechanism of FIG. 2, illustrating the retention system of the present invention.

FIG. 3 is a partly exploded view of the storage cell 105 that forms part of the ammunition feeding mechanism 10 of FIG. 2. The storage cell 105 is characterized by the retention system 100 according to a preferred embodiment of the present invention. The storage cell 105 includes a generally cylindrically shaped, hollow canister 300, and the retention system 100 that is mounted onto the canister 300 for securing and protecting the round, i.e., 11, within the ammunition feeding mechanism 10 of the automated weapon 5, and for further selectively and safely ejecting the round, i.e., 11, from its corresponding storage cell, i.e., 105. In this embodiment, the canister 300 is open at both its front end 250 and ifs rear end 251.

The retention system 100 is generally formed of a front door assembly 301, a rear door assembly 303, a central support collar 379, and a clamping spring 370. The front door assembly 301 and the rear door assembly 303 are generally similar in design and function, and thus only the front door assembly 301 will be described in greater detail.

Considering now the front door assembly 301, it generally includes a front door shaft 356, a front rotating door 380, a front door release lever 350, a front door return spring 357, a first front door shaft support 358, and a second front door shaft support 308.

The front door shaft 356 is preferably, but not necessarily, a metallic rod whose length is approximately equal to half the length of the canister 300 plus the thickness of the assembled front door linking collars 375, 376 and the front rotating door 380.

The front rotating door 380 is made of a crescent-shaped metallic sheet. It is secured to forward end of the front door shaft 356, so that it selectively opens and closes the front open end 250 of the canister 300. In this illustration, the front door shaft 356 can be rotated by approximately fifty-five (55) degrees. Concurrently, and as further illustrated in FIG. 12, the closed front rotating door 380 provides support to a nose 1205 (FIG. 12) of the round 11.

Figure 7:
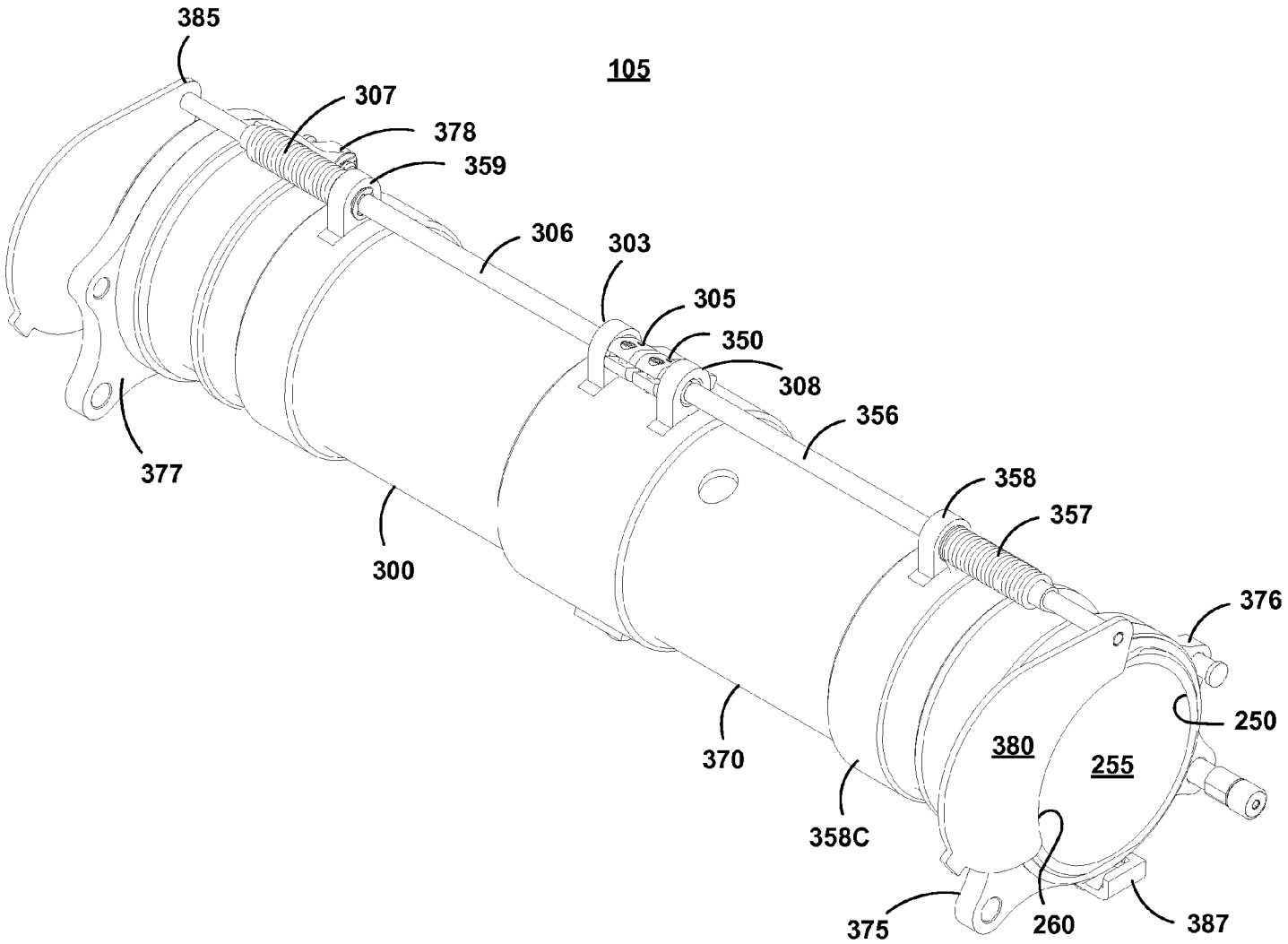
FIG. 7 is an isometric perspective view of the storage cell of FIG. 3, showing the front and rear rotating doors open.
Figure 8A:
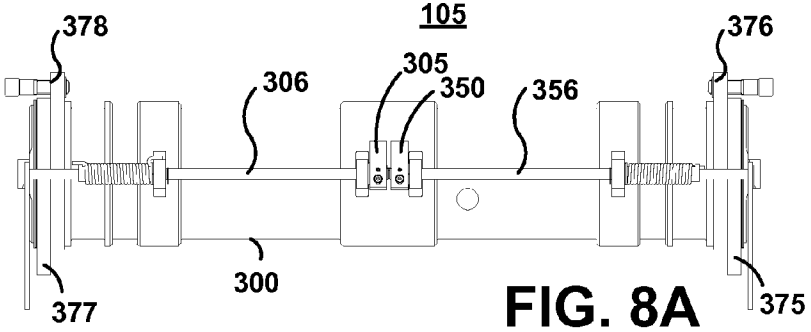
FIG. 8 includes FIGS. 8A, 8B, 8C, 8D, and 8E, and represents various views of the storage cell of FIG. 7.
Figure 8B:
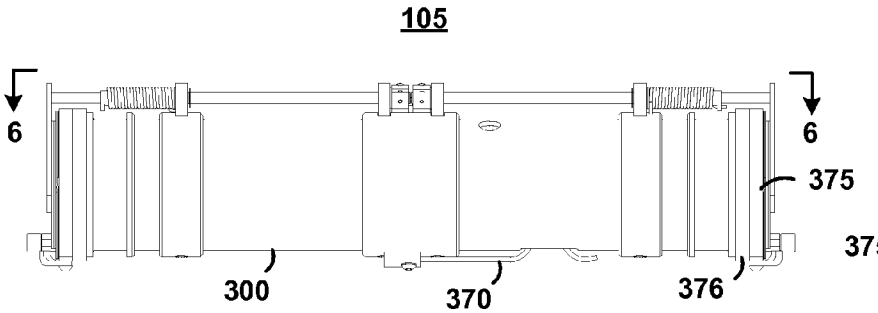
Figure 8C:
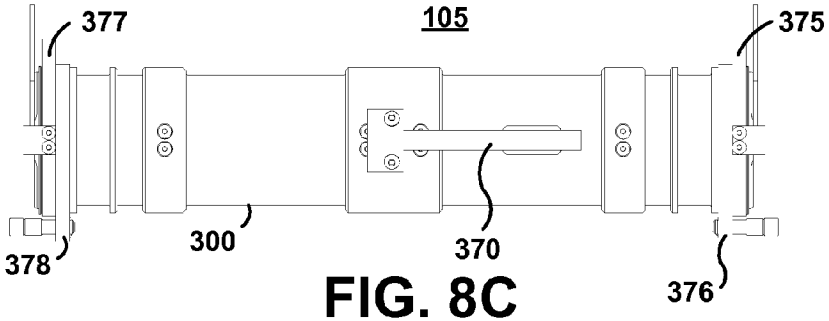
Figure 8D:
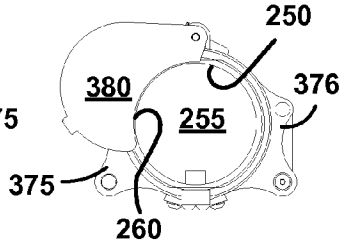
Figure 8E:
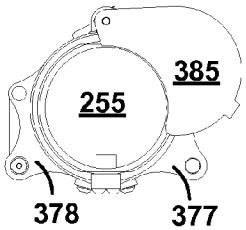
Figure 9:
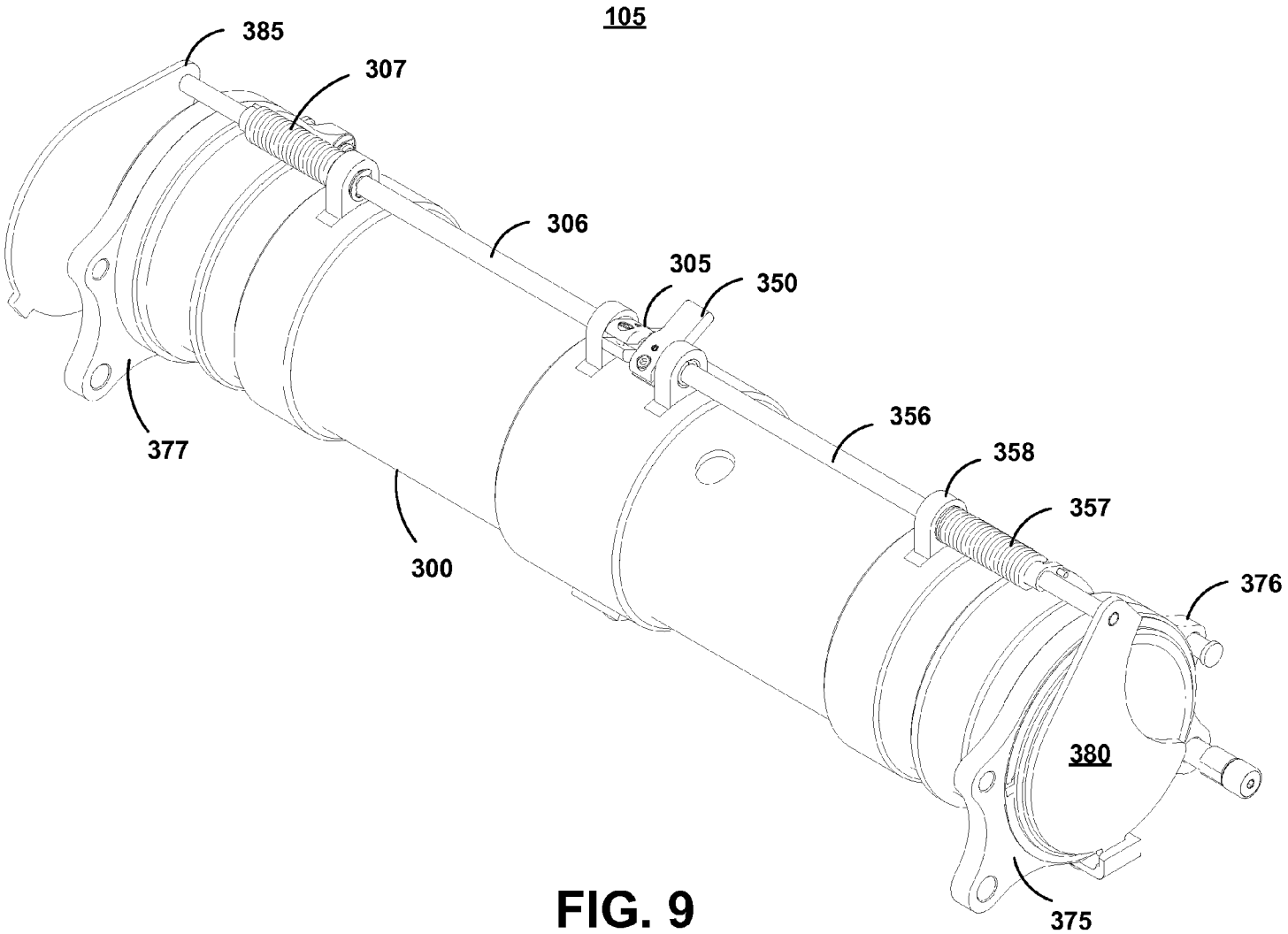
FIG. 9 is an isometric perspective view of the storage cell of FIG. 3, showing the front rotating closed and the rear rotating door open.
Figure 10A:
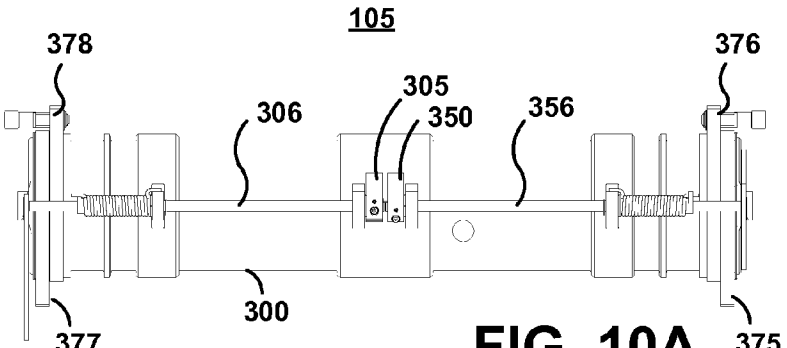
FIG. 10 includes FIGS. 10A, 10B, 10C, 10D, and 10E, and represents various views of the storage cell of FIG. 9.
Figure 10B:
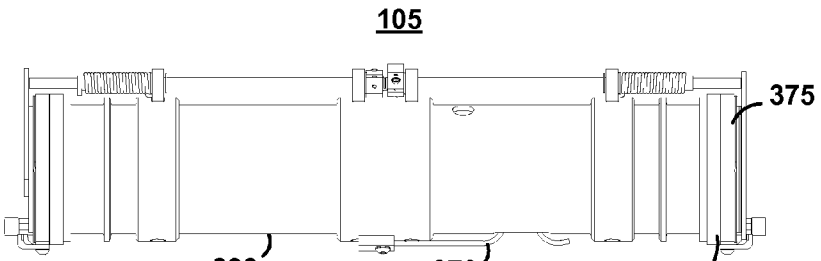
Figure 10C:
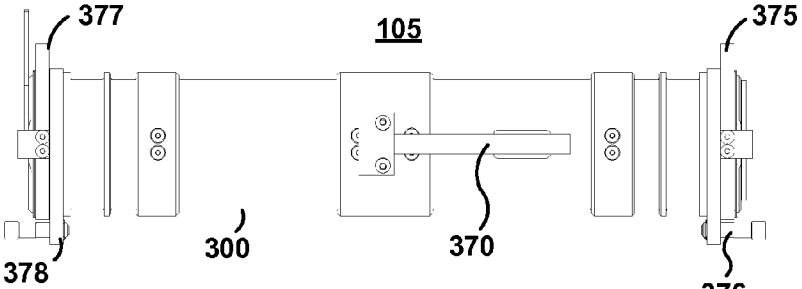
Figure 10D:
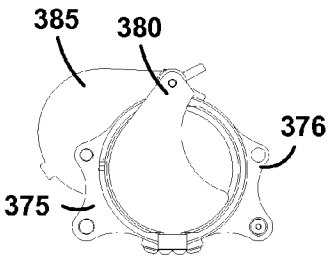
Figure 10E:
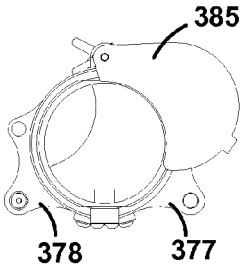

In addition, as further illustrated in FIGS. 7 and 8D, the front rotating door 380 includes a circularly shaped inner contour 260 that has a generally similar diameter as that of the front end 250 of the canister 300. As a result, when the front rotating door 380 is in an open position, the inner chamber 255 of the canister is fully opened and exposed, to allow unhindered expulsion of the round 11.

Figure 4:
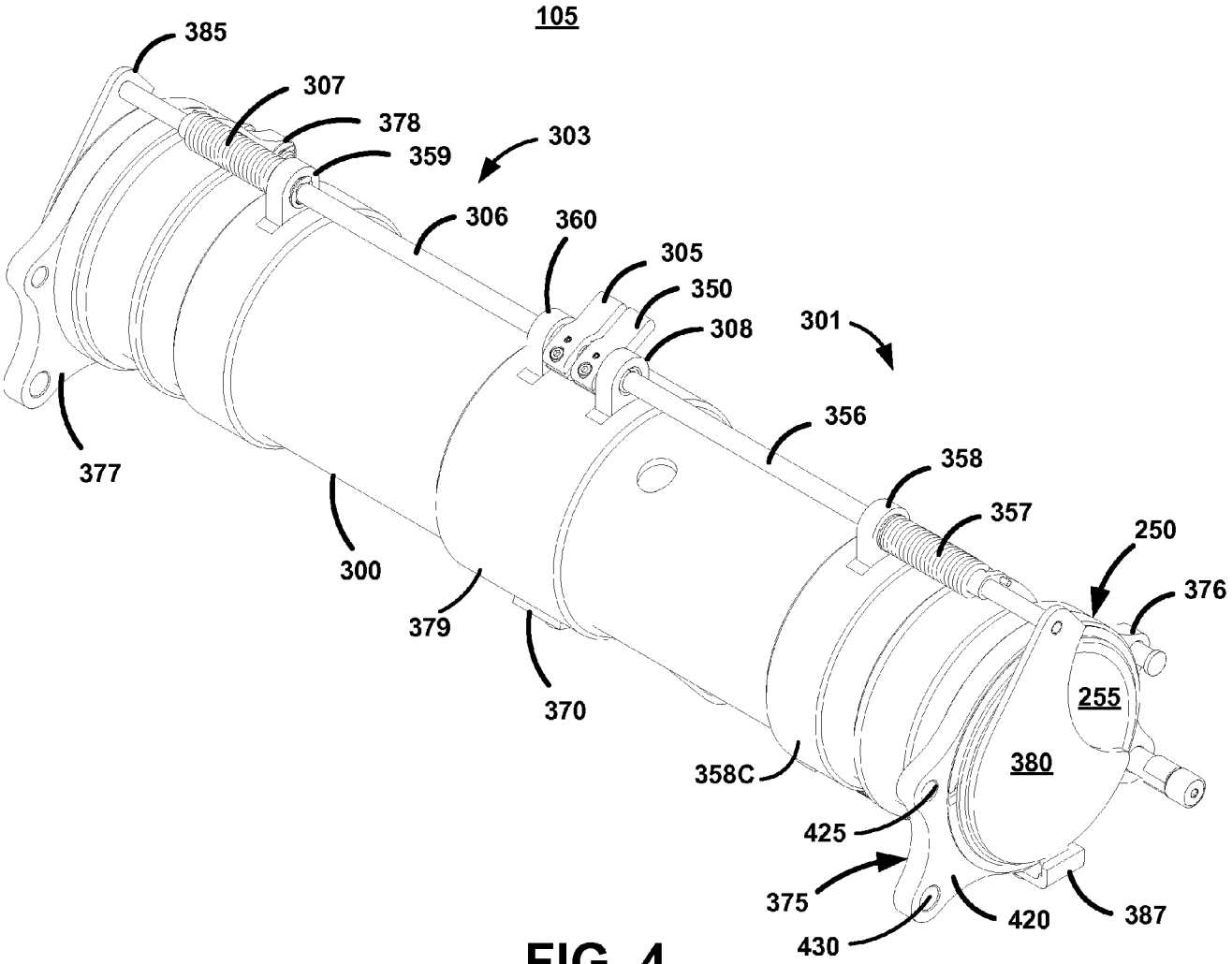
FIG. 4 is an isometric perspective view of the assembled storage cell of FIG. 3, showing a front and rear rotating doors closed.

With reference to FIGS. 3 and 4, the front door return spring 357 is firmly secured to the forward end of the front door shaft 356. The other, or rearward, end of the front door return spring 357 presses against the forward side of the first front door shaft support 358, in order to keep the front rotating door 380 in a closed position when the storage cell 105 is assembled. The front rotating door 380 includes a lip 382 that engages a lock 387 (FIG. 3), which is mounted on the front end 250 of the canister 300 (FIG. 4).

With further reference to FIGS. 4 and 7, when the storage cell 105 is assembled, the front door release lever 350 is firmly secured to the rearward end of the front door shaft 356 and rests against the rearward end of the second front door shaft support 308. As a result of this configuration, when the front door release lever 350 is in a default (i.e., not pressed) state, it rests in an upward position (FIG. 4). However, as illustrated in FIG. 7, when it is desired to open the front rotating door 380 and the rear rotating door 385, the front door release lever 350 is pressed downward to cause the front door shaft 356 to rotate clockwise (as viewed from the front end of the storage cell 105).

In the embodiment illustrated in FIGS. 3 and 4, the first front door shaft support 358 is secured to a collar 358C, which in turn, is securely mounted on the outer periphery of the collar 300. Similarly, the second front door shaft support 308 is secured to the central support collar 379, which in turn, is securely mounted onto the collar 300.

The front door linking collars 375, 376 are generally similar in design and construction, and therefore only the collar 375 will be described in more detail. The collar 375 is formed of a cylindrical ring 415 (FIG. 3) having a circular cross-section. The inner diameter of the ring 415 is selected so that the collar 375 can be securely fitted on the front end 250 of the canister 300.

With reference to FIG. 4, the collar 375 further includes a shoulder 420 that is provided with two holes 425, 430. The shoulder 420 protrudes outwardly to enable the engagement of the collar 375 to another storage cell on one side, i.e., left side, of the storage cell 105, in a chain configuration, as shown in FIG. 2, by means of two pins 372, 373. Pins 372 and 373 allow for connection to a subsequent magazine cell, while pin 373 also incorporates a roller, which ensures the smooth operation of the magazine 10 as it revolves within its housing. The ring 415 includes an inner, flat shoulder 371 that engages a groove or cutout 391 in cell 300, thereby axially restraining collar 375 (and similarly collar 376).

As illustrated in FIG. 5D, the collar 376 includes a shoulder 435 that is similar in design and function to the shoulder 420, and that protrudes outwardly to enable the engagement of the collar 376 to another storage cell another side, i.e., right side, of the storage cell 105, in a chain configuration.

Considering now the rear door assembly 303 in connection with FIGS. 3 and 4, it is generally similar in design and function to the front door assembly 301, and includes a rear door shaft 306, a rear rotating door 385, a rear door release lever 305, a rear door return spring 307, a first rear door shaft support 359, and a second rear door shaft support 360.

FIG. 3 further illustrates the clamping spring 370 as being formed of a base 390 secured to a preformed spring 392 that is formed of a flat linear arm 377 and a raised head 374. The base 390 is secured to the bottom of the central support collar 379 by known or available means, such as screws or bolts.

Figure 6:
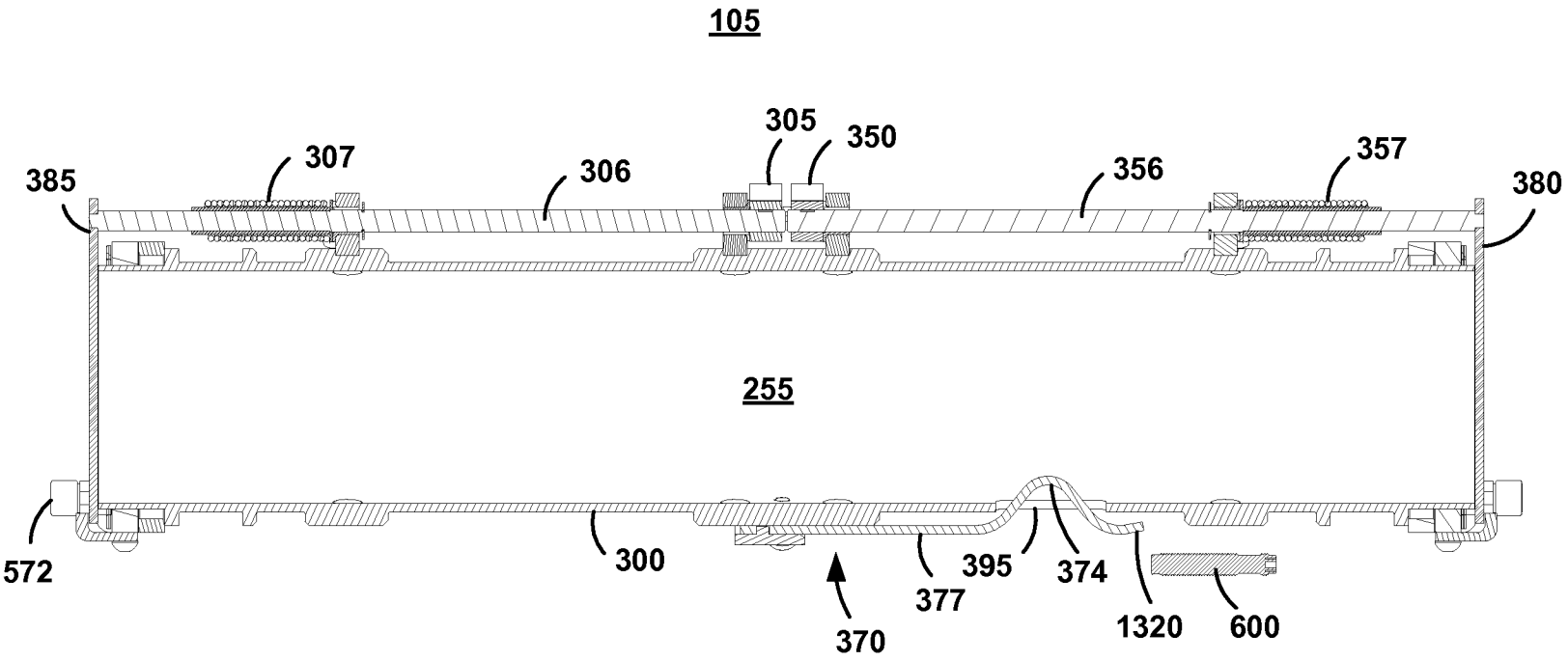
FIG. 6 is an enlarged, cross-sectional view of the storage cell of FIG. 5A, taken along line 6-6 thereof.

In operation, and with further reference to FIG. 6, if the storage cell 105 does not contain an round 11, then the arm 377 of the clamping spring 370 extends generally parallel to the canister 300, with its head 374 extending through an opening 395 to the inner chamber 255. The retention system 100 further includes a proximity sensor 600 that is disposed in the vicinity of the clamping spring 370, and is mounted of the magazine housing so that when the head 374 of the central spring 370 is unbiased by the round 11, then the head 374 will fall out of the range of the proximity sensor 600, to indicate that the storage cell 105 does not house the round 11.

If the storage cell 105 contains a round 11, then, as shown in FIG. 12, the head 374 pushes against the round 11 to provide it with lateral support, causing the arm 377 to bend downward away from the canister 300, and the head 374 to fall into the range of the proximity sensor 600, to indicate the presence of the round 11, thus providing an expeditious inventory of the rounds within the ammunition feeding mechanism 10.

Figure 13:
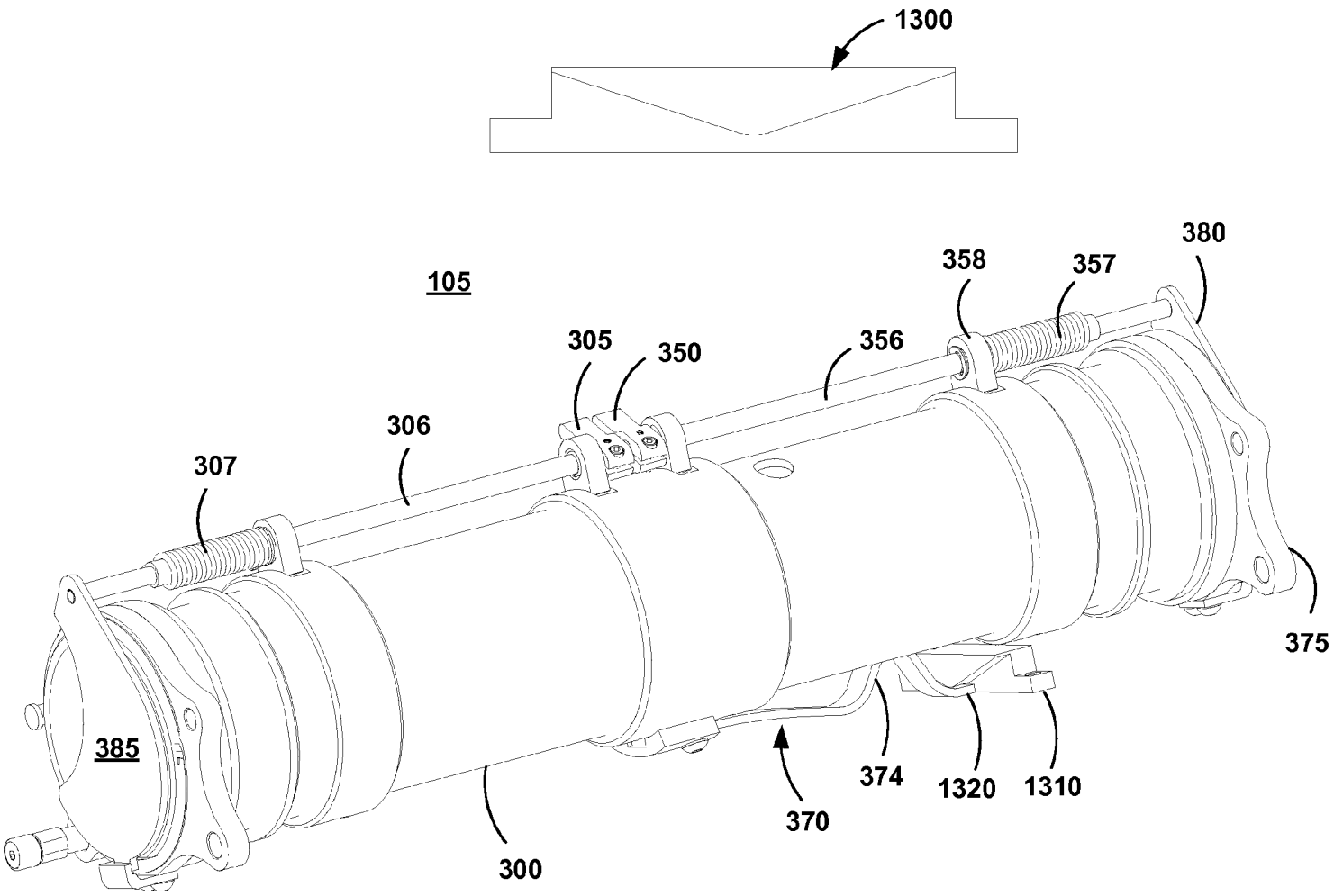
FIG. 13 is an isometric perspective view of the storage cell of FIG. 4, further illustrating the retraction of the clamping spring by the cam.

As shown in FIG. 13, the retention system 100 includes a clamp release cam 1310 that interfaces with a farthermost end 1320 of the head 374, as the storage cell 105 is advanced to the firing position, in order to depress the clamping spring 370 and to retain it in a depressed state, in order to completely release the round 11.

FIGS. 4 through 15 illustrate various stages of the operation of the storage cell 105. FIGS. 4, 5, and 6 represent various views of the storage cell 105 with both the front rotating door 380 and the rear rotating door 385 closed. FIGS. 7 and 8 represent various views of the storage cell 105 with both the front rotating door 380 and the rear rotating door 385 open.

Figure 14:
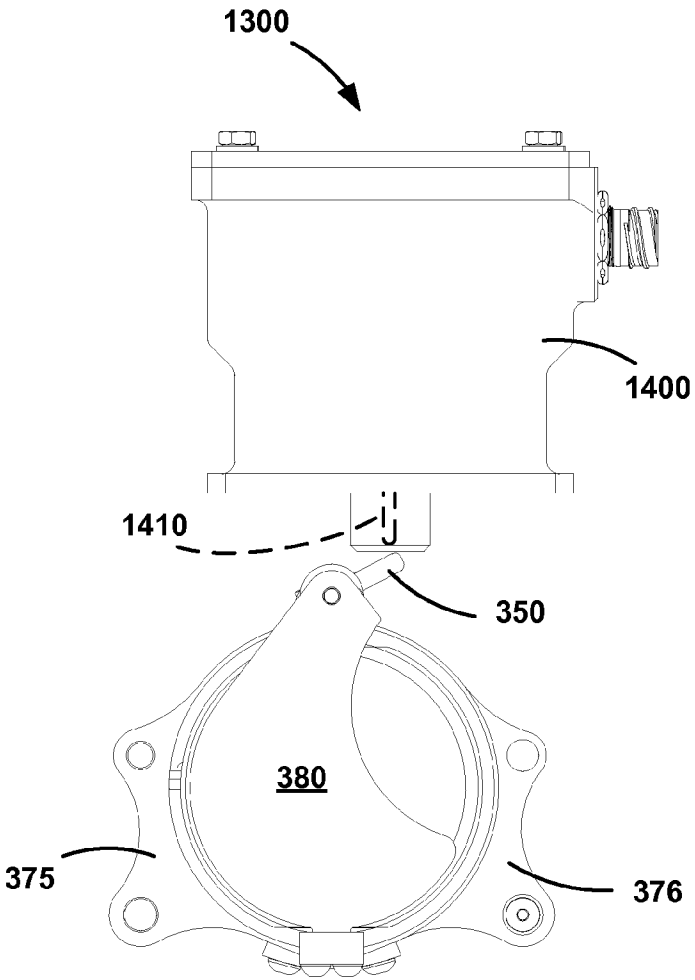
FIG. 14 is a front view of the storage cell of FIG. 13, illustrating a plunger of a firing solenoid actuator in a retracted position, with the front rotating door closed.
Figure 15:
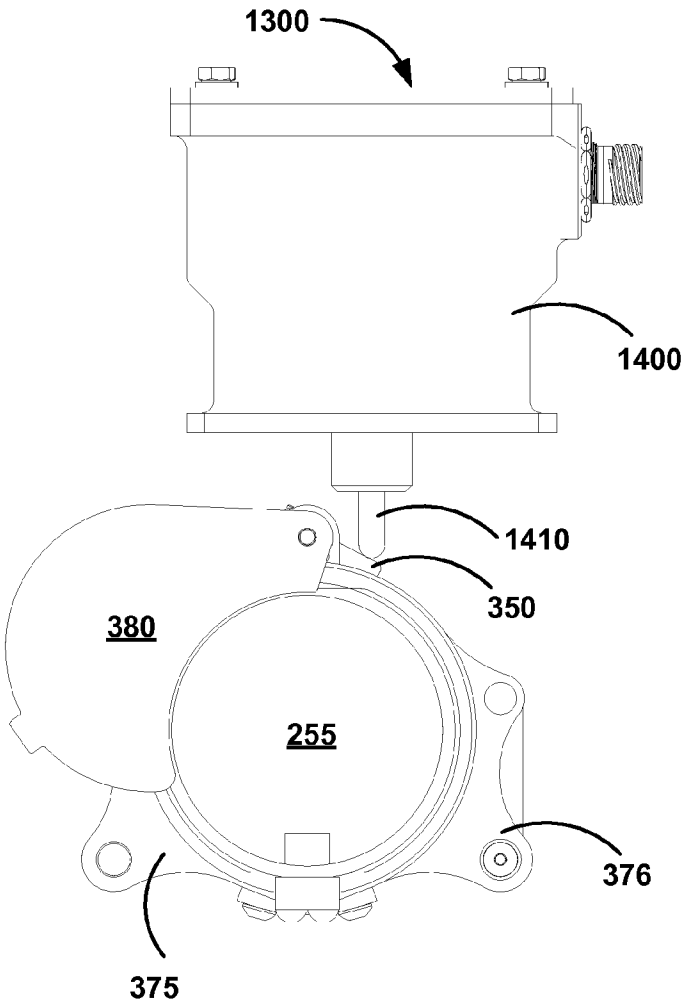
FIG. 15 is a front view of the storage cell of FIG. 14, illustrating the plunger of the firing solenoid actuator of FIG. 14 in an extended (or deployed) position, causing the front and rear rotating doors to open.

As further illustrated in FIGS. 13 through 15, the retention system 100 includes an actuator 1300 that is disposed at a short distance from the front door release lever 350 and the rear door release lever 305. The actuator 1300 generally includes two solenoids 1400, each with a plunger 1410 (only one solenoid 1400 and one plunger 1410 are illustrated in FIGS. 14, 15). Both solenoids and plungers are similar in design and function, and therefore only one plunger 1410 will be described herein in more detail. The plunger 1410 is disposed atop the front door release lever 350 and the other plunger (not shown) is disposed atop the rear door release lever 305.

When the plunger 1410 is retracted, as is illustrated in FIG. 14, the front door release lever 350 is in an upward position, causing the front rotating door 380 to remain closed. In the illustration shown in FIG. 15, the solenoid 1400 is activated so that only the plunger 1410 is extended downward to push down on the front door release lever 350, causing both the front rotating door 380 and the rear rotating door 385 to be opened.

Similarly, when it is desired to open the rear rotating door 385, as illustrated in FIGS. 7, 8, 9, and 10, the solenoid 1400 is activated so that the plunger (not shown) associated with the rear door release lever 305 is extended downward to push down on the rear rotating door 385.

As a result of this design, the firing position is distinct from the loading position. One solenoid plunger 1410 is located above the firing position that is aligned with the front door release lever 350. The other solenoid plunger (not shown) is located above the rear door release lever 305 in the loading position. The firing solenoid does actuate actuate the rear door release lever 305 and the loading solenoid does not actuate the front door release lever 350.

Figure 11:
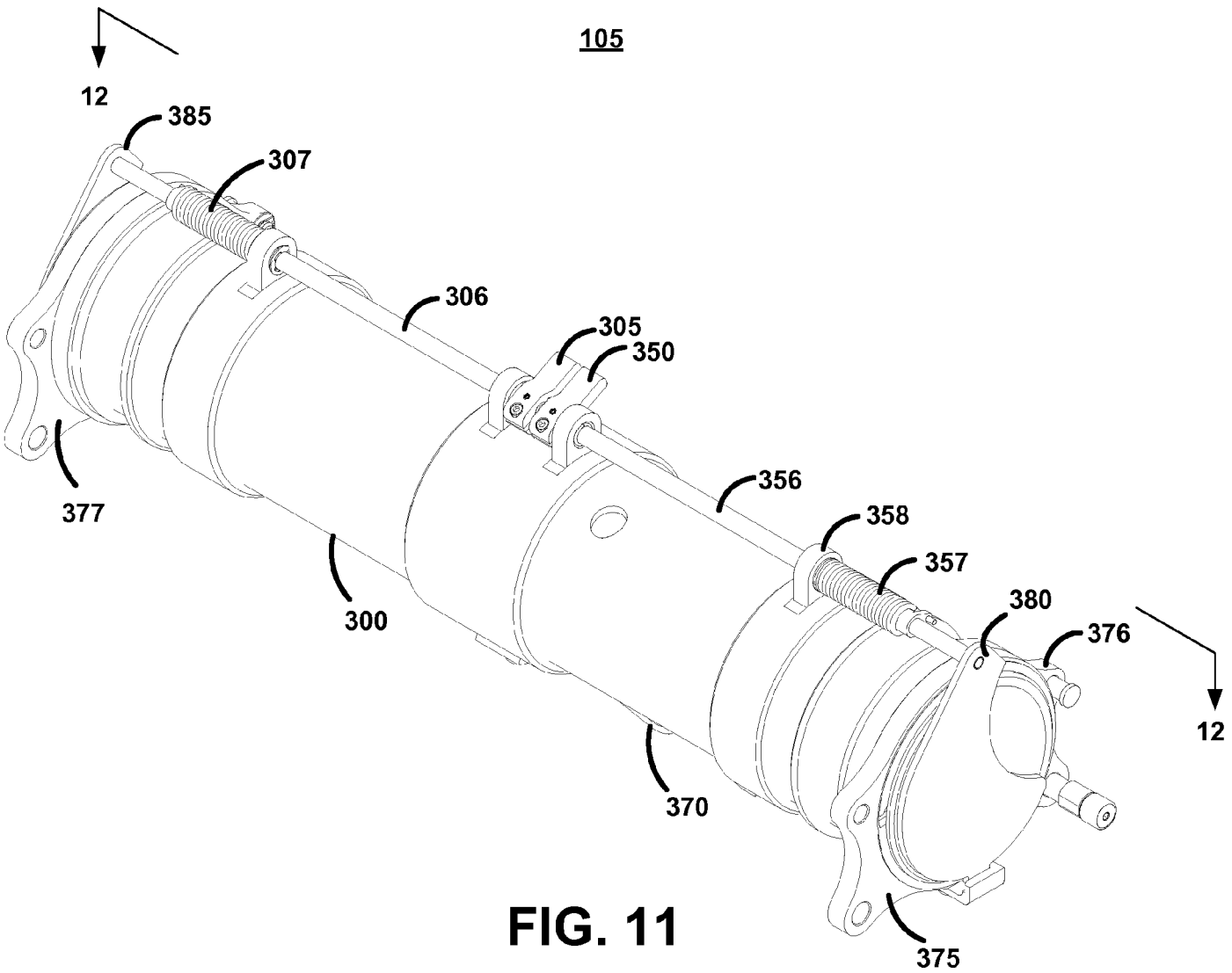
FIG. 11 is an isometric perspective view of the storage cell of FIG. 3, shown in a loaded state, with both the front and rear rotating doors closed.
Figure 12A:
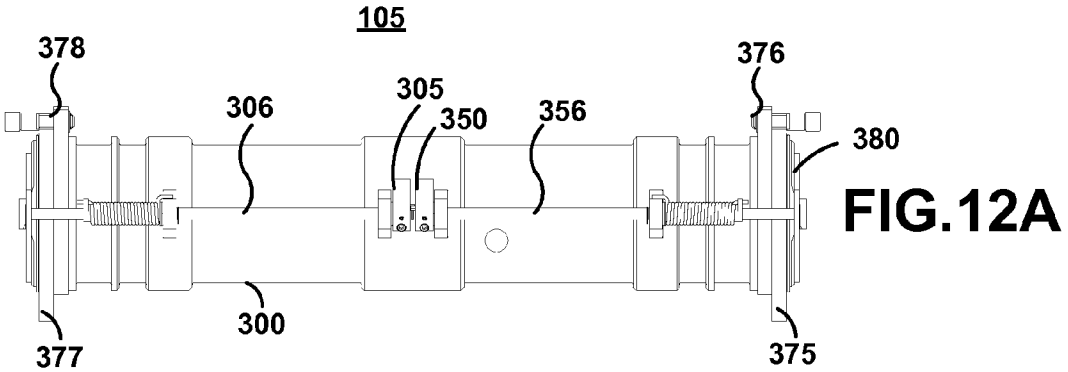
FIG. 12 includes FIGS. 12A, 12B, 12C, 12D, and 12E, and represents various views of the storage cell of FIG. 11, with FIG. 12B being a cross-sectional view of the storage cell of FIG. 11, taken along line 12-12 thereof.
Figure 12B:
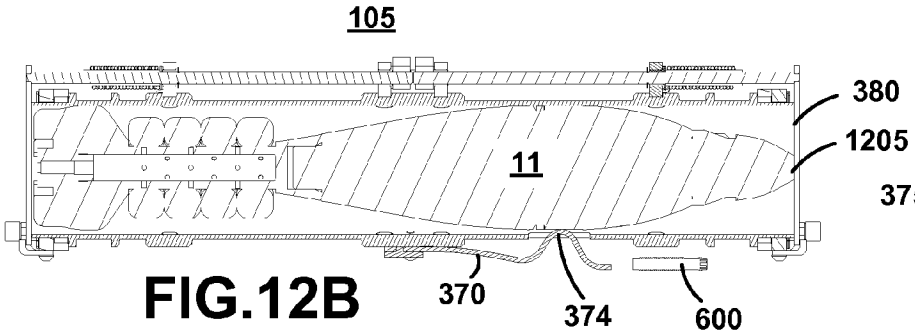
Figure 12D:
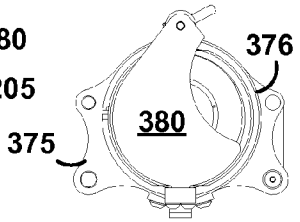
Figure 12C:
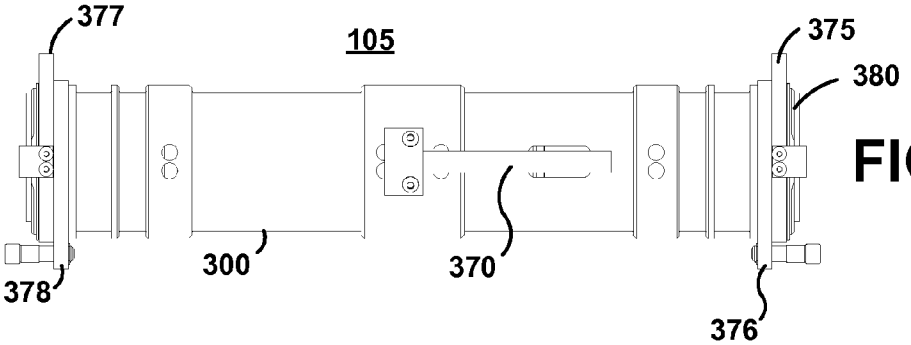
Figure 12D:
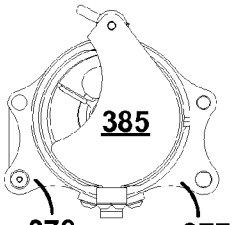

FIGS. 11 and 12 illustrate various views of the storage cell 105 in a loaded state, with both the front rotating door 380 and the rear rotating door 385 closed, and the front door release lever 350 and the rear door release lever 305 in an upward unbiased position.

FIGS. 16 through 19 illustrate various views of the gun tube clearance cell 1600 of FIG. 2. While the present exemplary embodiment is described as including a single gun tube clearance cell 1600, it should be clear that a different number of gun tube clearance cells may be used, without departing from the teaching of the present invention.

The gun tube clearance cell 1600 is generally similar in design construction to the storage cell 105, but is functionally different therefrom. The gun tube clearance cell 1600 is primarily designed to ascertain that the gun tube 30 is clear and unobstructed and to provide a safe transport position for the recoiling system. The gun tube clearance cell 1600 is different than the other storage cells (i.e., 105) because it is not meant to store an round.

Figure 20:
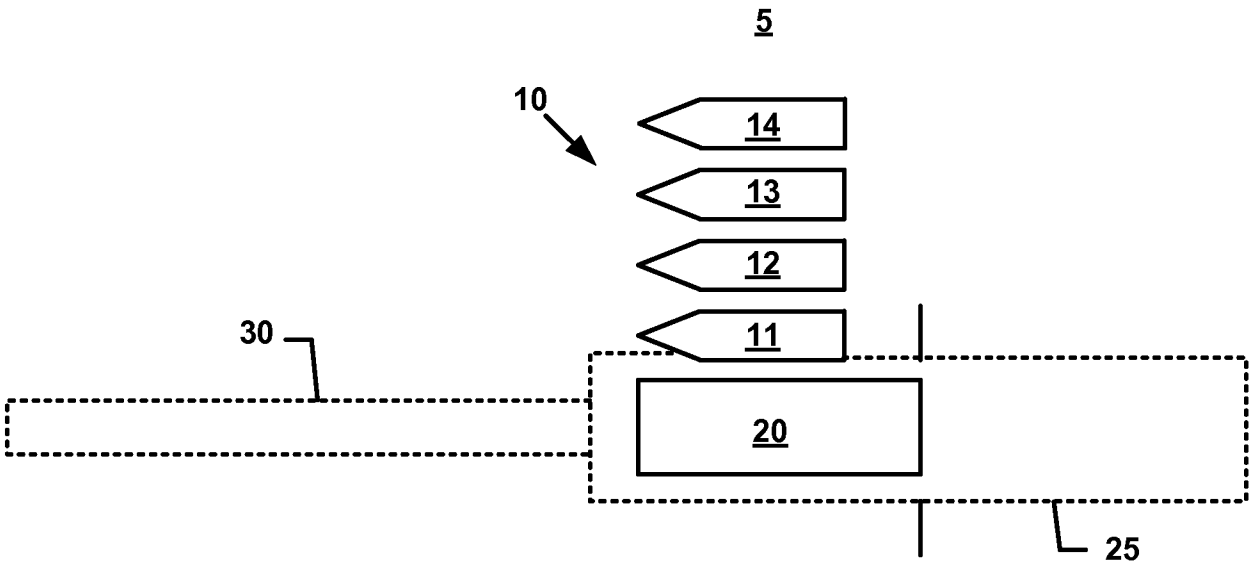
FIG. 20 is a schematic view of the automated weapon of FIG. 1, showing the recoiling mass of the automated weapon stowed inside the gun tube clearance cell of FIGS. 15 through 19.

In a preferred embodiment, the gun tube clearance cell 1600 is open at both ends, so that the recoiling mass 20 of the automated weapon 5 can be stored in the forward position for safety (i.e., not cocked back), as shown in FIG. 20. The gun tube clearance cell 1600 includes a generally cylindrically shaped, hollow canister 1605, an optical (or ultrasonic) release assembly 1610, an ultrasonic source 1650, and a chain link assembly 1675.

Considering now the canister 1605, it is generally similar in design and construction to the canister 300 as described earlier. The chain link assembly 1675 includes two front end linking collars 1677, 1679 that are secured to the front end of the canister 1605, and that are similar in design, construction, and function to the linking collars 375, 376.

The chain link assembly 1675 further includes two rear end linking collars 1682, 1684 that are secured to the rear end of the canister 1605, and that are similar in design, construction, and function to the linking collars 377, 378. In this particular embodiment, the gun tube clearance cell 1600 does not include neither a front door nor a rear door, with the understanding that other embodiments of the present invention might selectively include a fixed rear door and/or a rotatable front door that is actuated similarly to the front rotating door 380, as described earlier.

Figure 18:
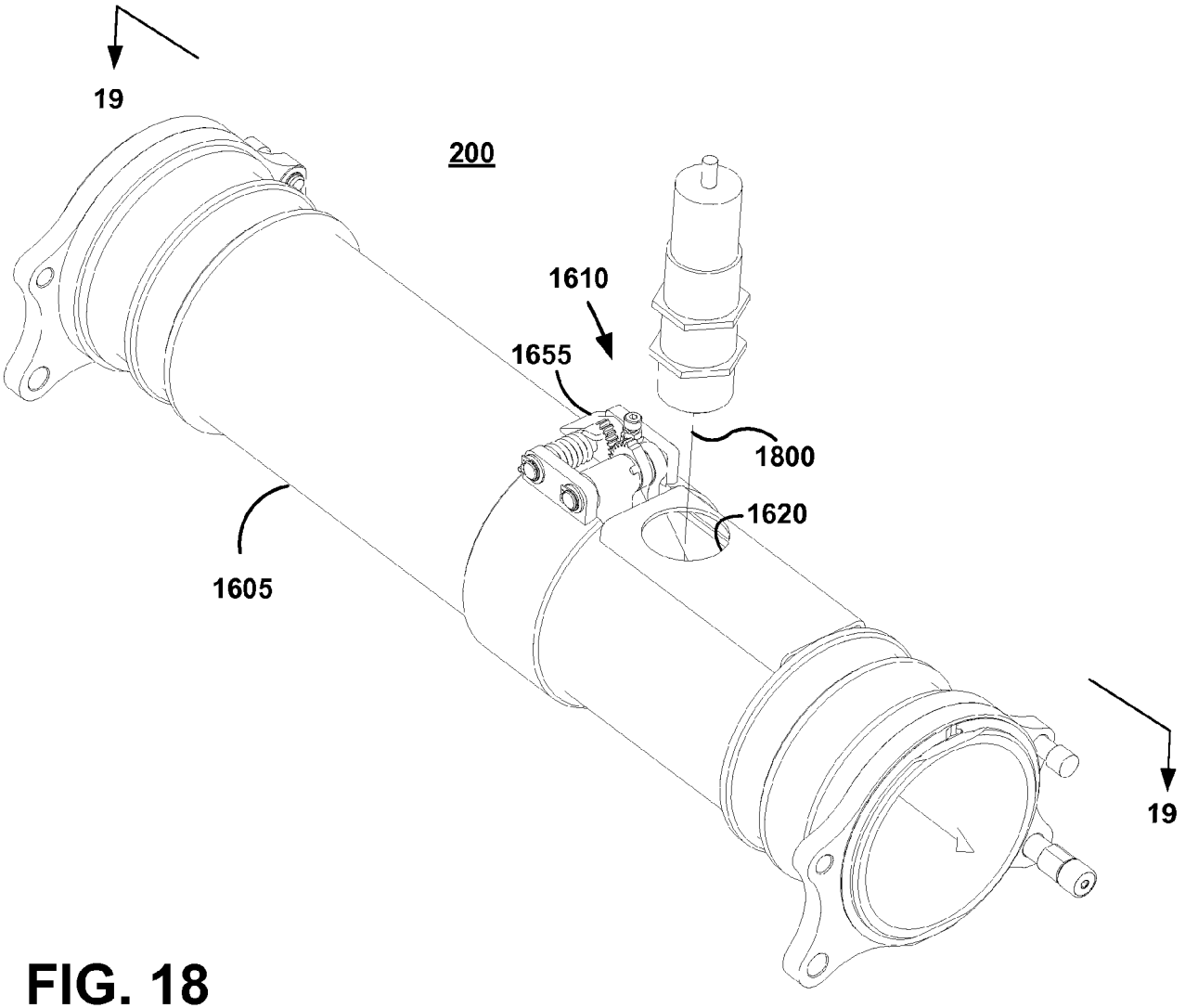
FIG. 18 is an isometric perspective view of the gun tube clearance cell of FIGS. 16 and 17, further illustrating the ultrasonic source in an activated state.

The ultrasonic source 1650 selectively generates and emanates an ultrasonic wave, as it will be explained later, in more detail, in connection with FIG. 18. The optical release assembly 1610 is generally formed of a collar 1611 that is mounted on the outer surface of the canister 1605. A rotatable reflective surface 1612 selectively rotates along an axis that is transverse to the axial direction of the canister 1605.

Figure 19:
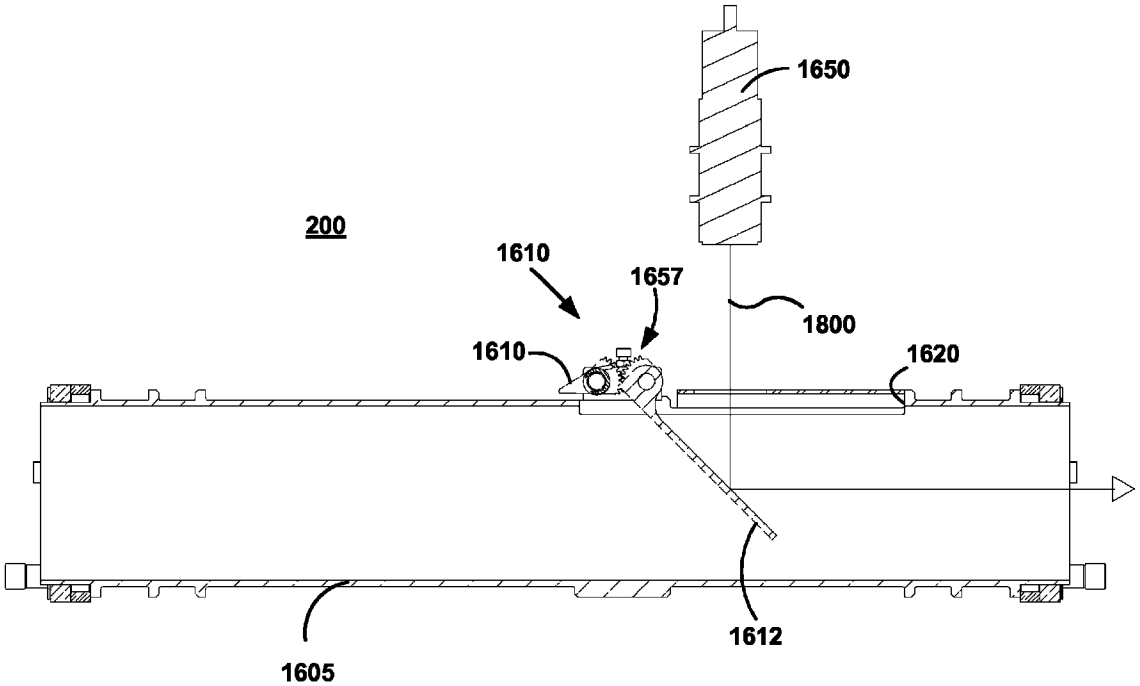
FIG. 19 is a cross-sectional, side view of the gun tube clearance cell and the ultrasonic source of FIG. 18, taken along line 19-19 thereof.

A lever 1655 is also mounted on the collar 1611, and is retained by a spring 1656. The lever 1655 and the rotatable reflective surface 1612 engage each other by means of meshing gears 1657 (FIGS. 17, 19).

Figure 16:
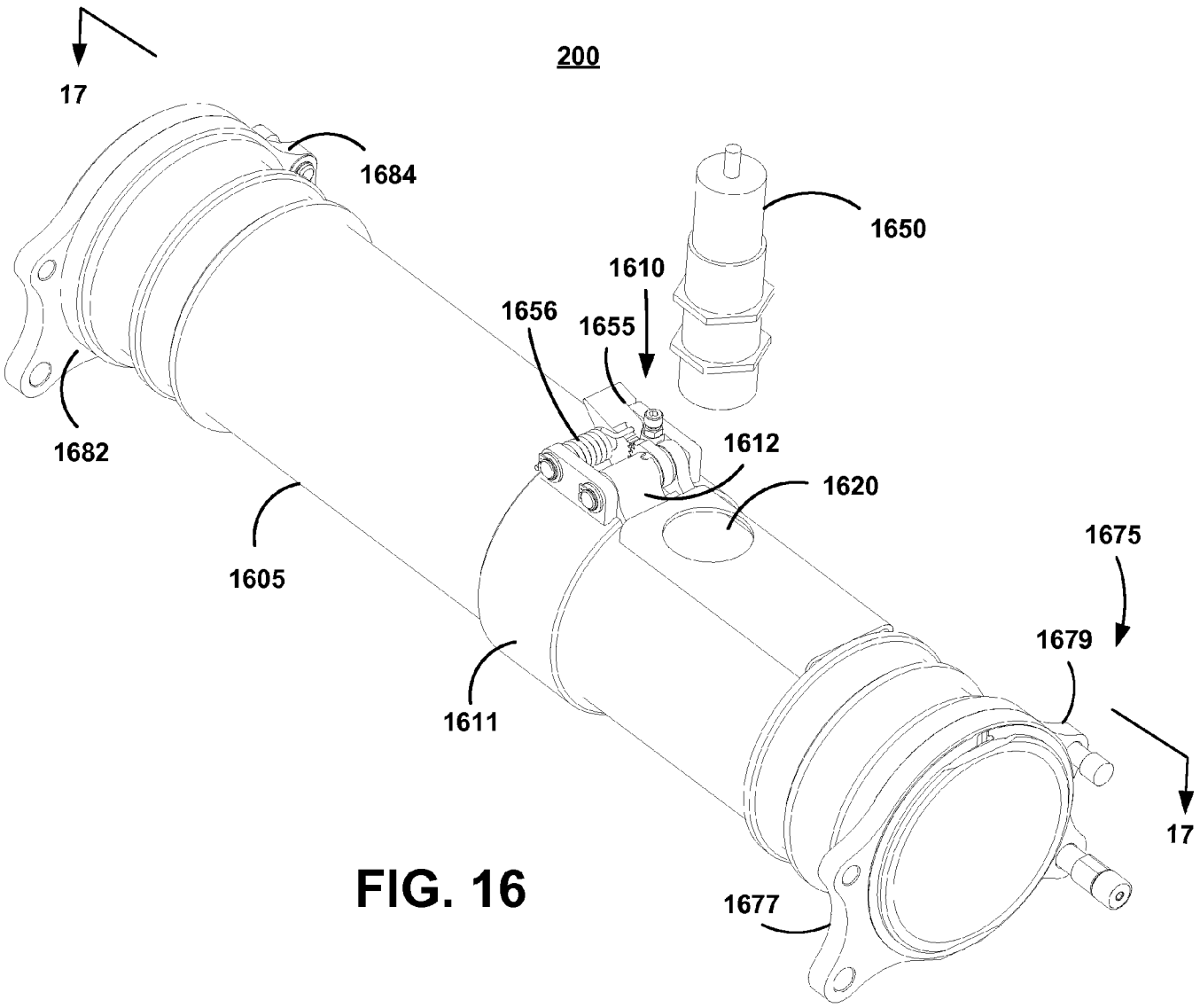
FIG. 16 is an isometric perspective view of the gun tube clearance cell of FIG. 2, further illustrating an ultrasonic source in a deactivated state.
Figure 17:
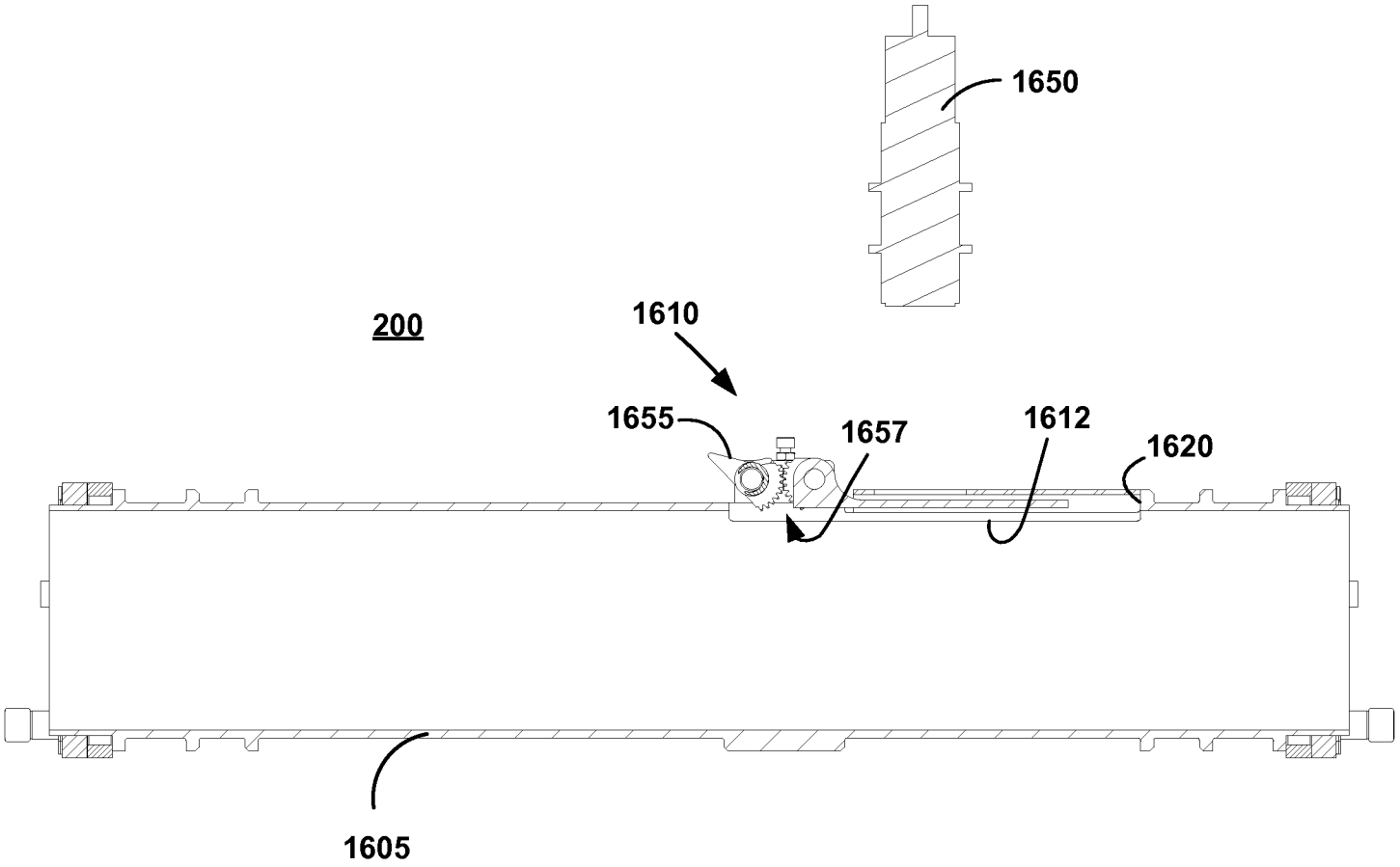
FIG. 17 is a cross-sectional, side view of the gun tube clearance cell and the ultrasonic source of FIG. 16, taken along line 17-17 thereof.

In operation, when the gun tube clearance cell 1600 is not functional, a spring 1656 retains the lever 1655 in an unbiased position and the rotatable reflective surface 1612 is stowed against the inner surface of the canister 1605 (FIGS. 16, 17). In use, a solenoid that is similar to the solenoid 1400 (FIGS. 14, 15), actuates the lever 1655, which engages the rotatable reflective surface 1612 and causes it to be lowered from a stowed position (FIG. 17) to an extended position, at for example 45° relative to the longitudinal axis of the canister 1605.

The ultrasonic source 1650 generates an ultrasonic wave 1800 that travels through the opening 1620 in the canister 1605, to be reflected by the rotatable reflective surface 1612, parallel to the longitudinal axis of the canister 1605. The ultrasonic source optical source 1650 further includes a sensor that evaluates the echo of the ultrasonic wave laser beam 1800 that is received back at the sensor. If no echo is received, the gun tube 30 is assumed to be free from obstruction.

It is to be understood that the phraseology and terminology used herein with reference to device or element orientation (such as, for example, terms like "front", "back", "up", "down", "top", "bottom", "forward", "rearward", and the like) are only used to simplify the description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

It is also to be understood that the invention is not limited in its application to the details of construction and the arrangements of components set forth in the following description or illustrated in the drawings. Other modifications may be made to the present design without departing from the spirit and scope of the invention. The present invention is capable of other embodiments and of being practiced or of being carried out in various ways, such as, for example, in military and commercial applications.

What is claimed is:

1. A gun tube clearance cell for ensuring that a gun tube is clear and unobstructed, comprising:

a hollow canister, an ultrasonic release assembly, and an ultrasonic source;

wherein the canister is generally cylindrically shaped;

wherein the ultrasonic release assembly includes a lever and a rotatable reflective surface that selectively rotates transversely to an axial direction of the canister;

wherein in operation, as the gun tube clearance cell is not functional, the rotatable reflective surface is stowed against an inner surface of the canister; and wherein in use, the rotatable reflective surface is actuated into an extended position, and the ultrasonic source is initiated in order to generate an ultrasonic wave, so that the ultrasonic wave travels through an opening in the canister to be reflected on the reflective surface, providing an indication if the gun tube may be used.

2. The gun tube clearance cell according to claim 1, wherein the travel path of the reflected ultrasonic wave is generally parallel to the axial direction of the canister.

3. The gun tube clearance cell according to claim 1, wherein the ultrasonic release assembly further includes a solenoid that actuates the lever which in turn engages the rotatable reflective surface, so that upon actuation of the lever, the reflective surface is pivots to the extended position.

4. The gun tube clearance cell according to claim 3, wherein the lever engages the rotatable reflective surface by means of meshing gears.

5. The gun tube clearance cell according to claim 1, wherein the ultrasonic release assembly includes a collar that is mounted on the outer surface of the canister;

wherein the optical release assembly further includes a spring that retains the lever; and wherein the spring and the collar are mounted on the collar.

6. The gun tube clearance cell according to claim 1, further includes a linking collar assembly that allows additional cells to be linked together to form a continuous chain.

7. The gun tube clearance cell according to claim 1, wherein the canister is open at both ends, to provide storage in a forward position for a recoiling mass of an automated weapon.

8. An ammunition feeding mechanism for use with an automated weapon, comprising:

a plurality of similarly storage cells, each cell adapted for storing a round within a canister and for allowing the round to be ejected; and a gun tube clearance cell for ensuring that a gun tube is clear and unobstructed;

wherein each storage cell includes:

a retention system that includes a front door assembly and a rear door assembly that retain the round within the canister;

wherein the front door assembly is fitted with a front door assembly that includes a front door and a front release lever;

wherein the rear door assembly is fitted with a rear door assembly that includes a rear door and a rear release lever;

wherein operation of the front release lever opens the front door and the rear door for firing;

wherein operation of the rear release lever opens the rear door for loading; and wherein the gun tube clearance cell includes:

a hollow canister, an ultrasonic release assembly, and an ultrasonic source;

wherein the canister is generally cylindrically shaped;

wherein the ultrasonic release assembly includes a lever and a rotatable reflective surface that selectively rotates transversely to an axial direction of the canister;

wherein in operation, as the gun tube clearance cell is not functional, the rotatable reflective surface is stowed against an inner surface of the canister; and wherein in use, the rotatable reflective surface is actuated into an extended position, and the ultrasonic source is initiated in order to generate an ultrasonic wave, so that the ultrasonic wave travels through an opening in the canister to be reflected on the reflective surface, providing an indication if the gun tube may be used.

* * * * *